US005222286A

United States Patent [19]

Saul et al.

[11] Patent Number: 5,222,286

[45] Date of Patent: Jun. 29, 1993

[54] MODULAR RECLINING/TILT CHAIR AND METHOD OF MAKING

[75] Inventors: Jonathan R. Saul, LaSalle; Karl J. Komorowski, Petersburg; Larry P. LaPointe, Temperance, all of Mich.

[73] Assignee: La-Z-Boy Chair Co., Monroe, Mich.

[21] Appl. No.: 819,784

[22] Filed: Jan. 13, 1992

Related U.S. Application Data

[63] Continuation-in-part of Ser. No. 772,231, Oct. 11, 1991.

[51] Int. Cl.[5] ..... A47C 1/02; B23P 11/00

[52] U.S. Cl. ..... 29/436; 29/434; 297/83; 297/342

[58] Field of Search ..... 29/91, 91.1, 434, 436; 297/83, 85, 259, 317, 318, 322, 329, 271, 340, 341, 342, 343, 344, DIG. 7

[56] References Cited

U.S. PATENT DOCUMENTS 1,048,306 12/1912 Greilick .
2,677,412 5/1954 Thomas .
2,918,110 12/1959 Schliephacke .
2,918,111 12/1959 Schliephacke .
2,919,745 1/1960 Schliephacke .
3,096,121 7/1963 Knabusch et al. .
3,567,280 3/1971 Bradshaw .
3,858,932 1/1975 Crum et al. .
3,904,240 9/1975 Rogers, Jr. et al. .
4,071,275 1/1978 Rogers, Jr. .
4,226,469 10/1980 Rogers, Jr. et al. .
4,291,913 9/1981 Kowalski .
4,364,603 12/1982 Johnson .
4,367,895 1/1983 Pacitti et al. .
4,740,031 4/1988 Rogers, Jr. .
5,011,220 4/1991 LaPointe .

*Primary Examiner*—Timothy V. Eley
*Attorney, Agent, or Firm*—Harness, Dickey & Pierce

[57] ABSTRACT

A modular reclining/tilt chair and method for assembling it are disclosed. The modular reclining/tilt chair includes a simplified actuation mechanism which significantly reduces system complexity and weight while providing improved comfort to the seat occupant. The construction is such that the pre-assembled actuation mechanism is integrally suspended from and interdependent with box-like modular frame components. In this manner, the frame components can be upholstered prior to final assembly with the actuation mechanism.

40 Claims, 8 Drawing Sheets

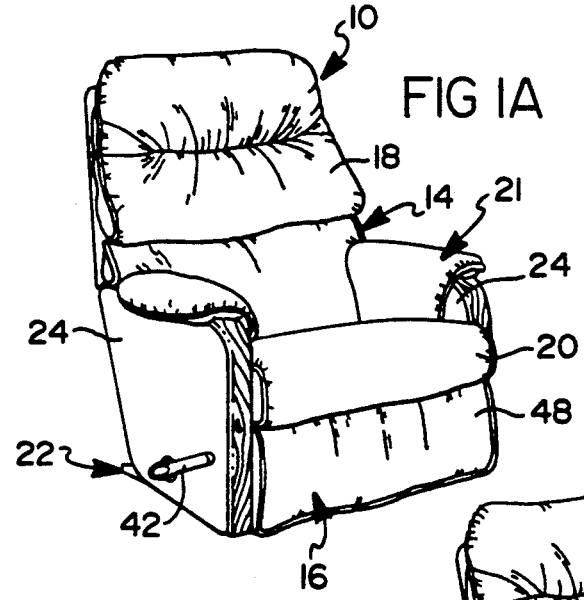
FIG IA
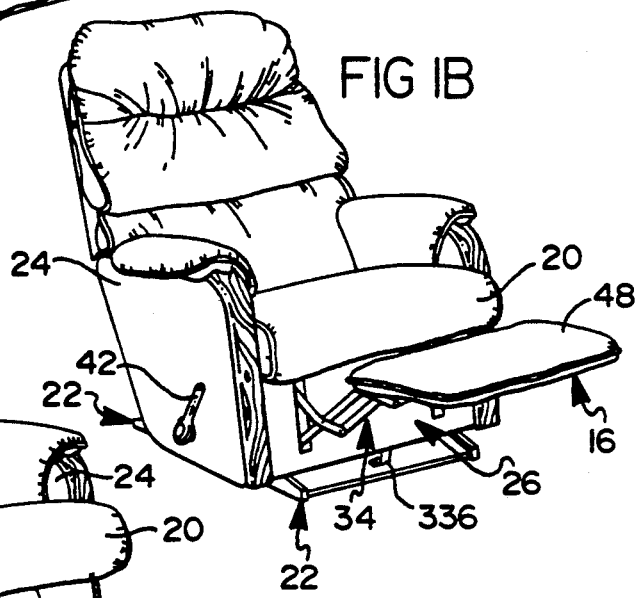
FIG IB
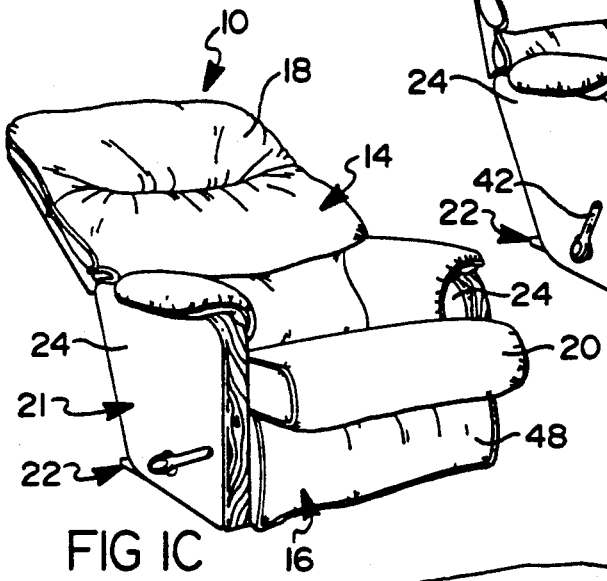
FIG IC
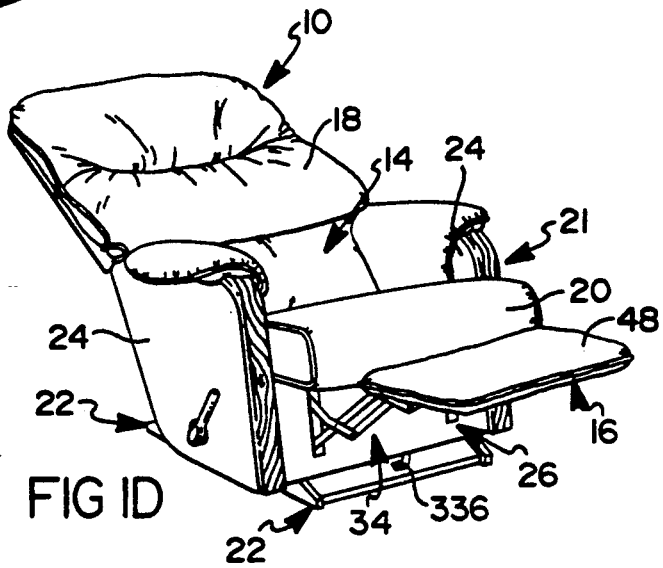
FIG ID

FIG 4
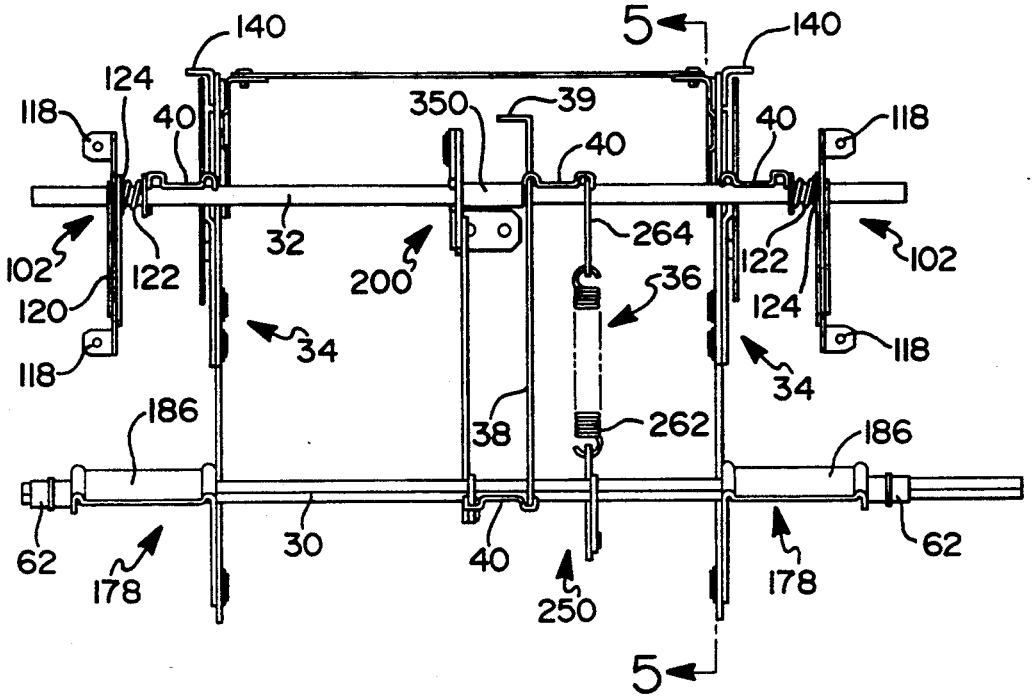
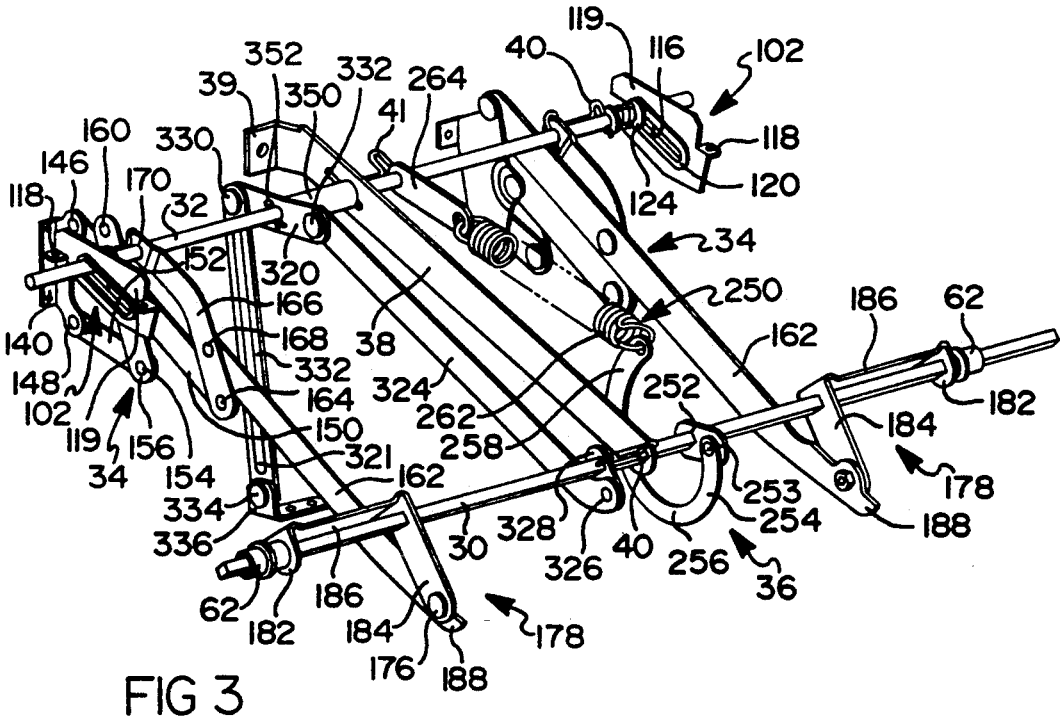
FIG 3

FIG 7D
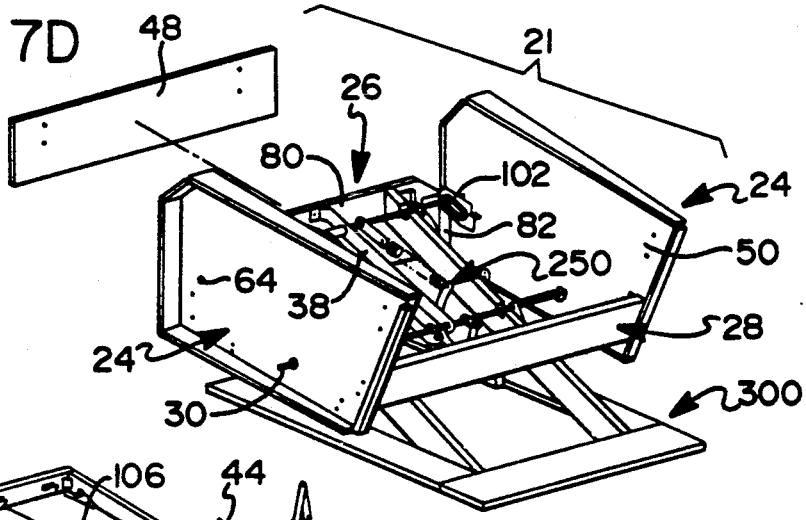
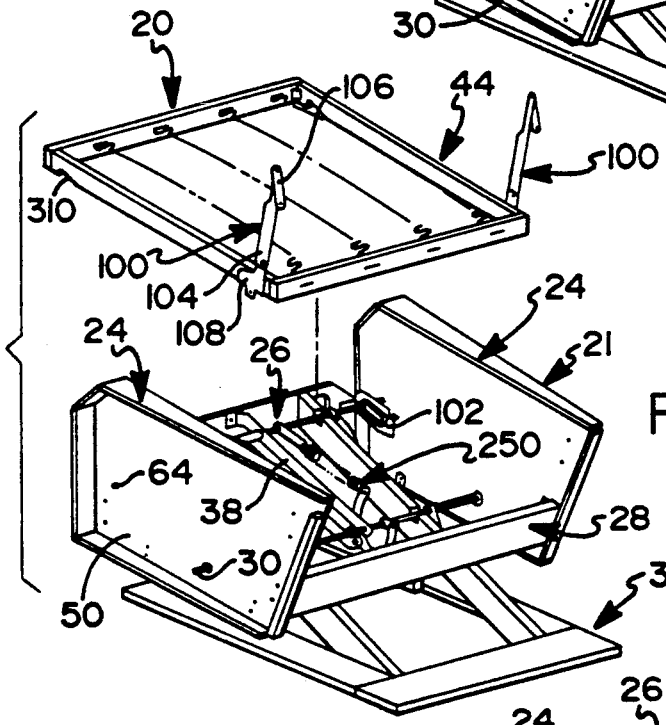
FIG 7E
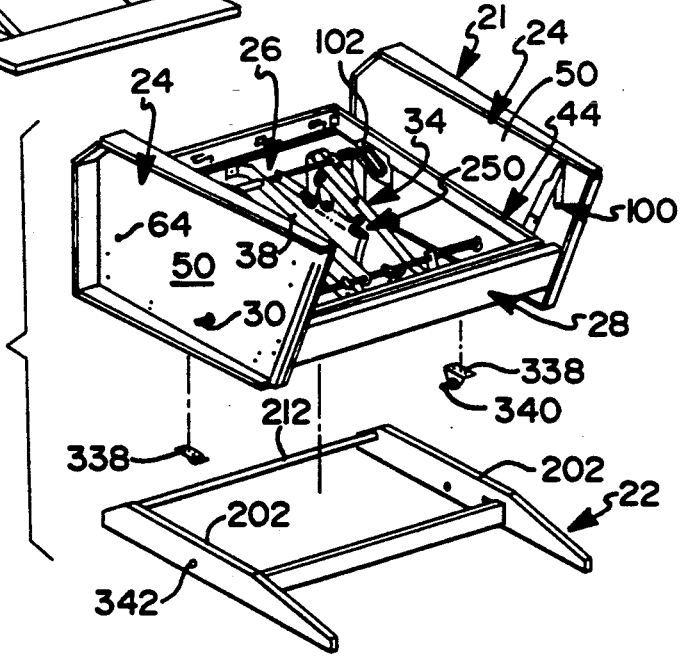
FIG 7F

MODULAR RECLINING/TILT CHAIR AND METHOD OF MAKING

This is a continuation-in-part of U.S. patent application Ser. No. 07/772,231, filed on Oct. 11, 1991, assigned to the common assignee of the present invention.

BACKGROUND OF THE INVENTION

The present invention relates generally to reclining chairs and, more particularly, to a method for assembling an improved reclining chair from pre-assembled modular components.

Traditionally, reclining chairs are equipped with an actuation mechanism which is operatively interconnected between a prefabricated chair frame and a stationary base assembly. In general, the actuation mechanism is a combination of various mechanical linkages operable for providing various comfort features such as independent reclining movement of a seat assembly as well as actuation of an extensible leg rest assembly and associated tilting of the chair body. Due to its relative complexity, it is common practice in the furniture industry to assemble the various mechanical linkages of the actuation mechanism into a stand alone mechanism frame assembly. A prefabricated U-shaped chair frame is frequently bolted around the mechanism frame with the open portion of the "U" corresponding to the front of the chair. In addition, the seat assembly is supported from the mechanism frame assembly for reclining movement with respect to the chair frame. Accordingly, such reclining chairs having a mechanism frame within a wood chair frame are commonly referred to as having a "frame within a frame" construction. As such, most furniture manufacturers do not upholster the exterior surfaces of the prefabricated chair frame until after the mechanism frame assembly has been installed. Unfortunately, the upholstering operation is very inefficient and expensive in that the frequently heavy and cumbersome prefabricated chair frame must be manually manipulated in an extremely labor-intensive manner.

In traditional reclining chair construction technique, the free ends of the U-shaped frame are attached on opposite sides at the front of the mechanism frame. However, the conventional mechanism frame typically comprises a narrow rail as the front frame of the chair during extension and retraction of the leg rest member. Accordingly, due to the small connection surface between the free ends of the U-shaped chair frame and the front member of the mechanism frame, the free ends of the U-shaped chair frame, which typically comprise chair arms, are susceptible to an undesirable degree of lateral deflection when side-to-side pressure is applied to the chair arms.

While many conventional reclining chairs operate satisfactorily, furniture manufacturers are continually striving to develop improved frames and actuation mechanisms for reducing system complexity and increasing structural soundness and smoothness of operation as well as occupant comfort. Furthermore, there is a continuing desire to develop improved fabrication and assembly techniques which will result in reduced costs while promoting increased efficiency and improved product quality.

SUMMARY OF THE INVENTION

In accordance with the principles of the present invention, an improved method for assembling an article of furniture is disclosed which is designed to overcome the disadvantages traditionally associated with fabricating, assembling and upholstering reclining-type chairs. Therefore, a primary object of the present invention is to provide a reclining chair which can be simply, efficiently, and rigidly assembled so as to significantly reduce its overall complexity, weight, and cost while providing improved operation and comfort to the seat occupant.

It is an additional object of the present invention to provide a three-way reclining chair which is adapted to permit selective and independent "reclining" movement of a seat back relative to a seat member as well as actuation (i.e. extending and retracting) of a leg rest assembly and simultaneous tilting of the chair frame relative to a stationary base. As such, the present invention provides a reclining/tilt chair wherein the minimal force achieved via shifting the weight of the seat occupant is utilized as the primary means for moving the seat assembly between an "upright" position and a "reclined" position.

It is another object of the present invention to reduce the input force exerted by the seat occupant for smoother operation of the actuation mechanism. As a related object, the complexity of improved actuation mechanism has been significantly simplified to incorporate mechanical linkage and drive components optimally designed for substantially reducing frictional losses so as to promote easier and smoother actuation. Moreover, the various operative linkages are designed to permit "pre-assembly" of the actuation mechanism without utilization of a conventional mechanism frame assembly.

It is still another object of the present invention to provide a simplified recliner chair frame which is structurally rigid, easy to assemble, and reduces lateral or "side-to-side" deflection of the chair arms.

In a preferred embodiment of the present invention, the integrated or "knock-down" construction of the reclining chair facilitates application of unique fabrication and assembly techniques which effectively result in increased production efficiency and cost savings while concomitantly producing a high-quality article of furniture. In general, the construction of the reclining chair is such that the pre-assembled actuation mechanism cannot be divorced from the pre-upholstered frame components which, when assembled, are rigidly interconnected to define a "box-like" chair frame or body from which the pre-assembled actuation mechanism is integrally suspended. In this manner, the conventional construction of supporting the actuation mechanism within a separate and distinct mechanism frame assembly is no longer required. The pre-assembled actuation mechanism includes a drive rod and a front support shaft which are each directly supported between left and right upholstered side frame assemblies. As such, extremely precise alignment of the actuation mechanism with respect to each of the separate pre-upholstered frame components is possible. Moreover, unique front and rear cross-rail assemblies interconnect the left and right side frame assemblies to define a "unitized" and extremely rigid box-like chair frame or body for inhibiting side-to-side flexion of the actuation mechanism suspended therein as well as of the side frame assemblies themselves. In addition to the structural and functional advantages associated with the modular reclining chair of the present invention, a unique method of assembling the pre-assembled actuation mechanism as an integrated component within the pre-upholstered frame components is disclosed.

The leg rest assembly may be operated by the seat occupant rotating an actuator lever through a limited angle which, in turn, rotates the drive rod for selectively extending or retracting a pair of leg rest pantograph linkages. The pantograph linkages are uniquely suspended for synchronous actuation between the drive rod and the front support shaft and protrude through elongated apertures provided in the front cross-rail assembly. In addition, an over-centered toggle mechanism is provided to assist in extending and retracting the leg rest assembly and in retaining the leg rest assembly in its "extended" and "stowed" positions.

Furthermore, the present invention relates to an improved combination reclining and "tilt" chair. The combination reclining/tilt chair is constructed such that normal tilting movement between the chair body and the stationary base assembly is permitted without causing the seat assembly to recline, but which can readily be reclined when desired. In addition, stop means are provided for securely positioning the chair body in its "non-tilted" and "tilted" positions. The stop means eliminates built in tolerances associated with the tilting linkages so that regardless of whether the chair is in its "leg rest retracted/non-tilted" or "leg rest extended/-tilted" position, the chair is rigidly stationary. Independent of the tilting action, slight backward pressure applied to the seat back is operable to initiate reclining movement of the seat assembly. Accordingly, an infinite number of reclined positions may be achieved upon the seat occupant shifting his or her body weight against the seat back.

Additional objects, advantages, and features of the present invention will become apparent from the following description and appendec claims, taken in conjunction with the accompanying drawings.

DESCRIPTION OF THE DRAWINGS

FIGS. 1A through 1D are perspective views of an exemplary reclining tilt chair apparatus shown in various operative positions, the "modular" components of which have been fabricated and assembled in accordance with the principles of the present invention;

FIG. 3 is an enlarged perspective view of the improved actuation mechanism shown in FIG. 2;

FIG. 4 is a plan view of the improved actuation mechanism shown in FIG. 3;

FIGS. 7A through 7H are various perspective views provided to illustrate a preferred method for assembling the reclining/tilt chair apparatus of FIGS. 1 and 2.

DETAILED DESCRIPTION OF THE INVENTION

Figure 2:
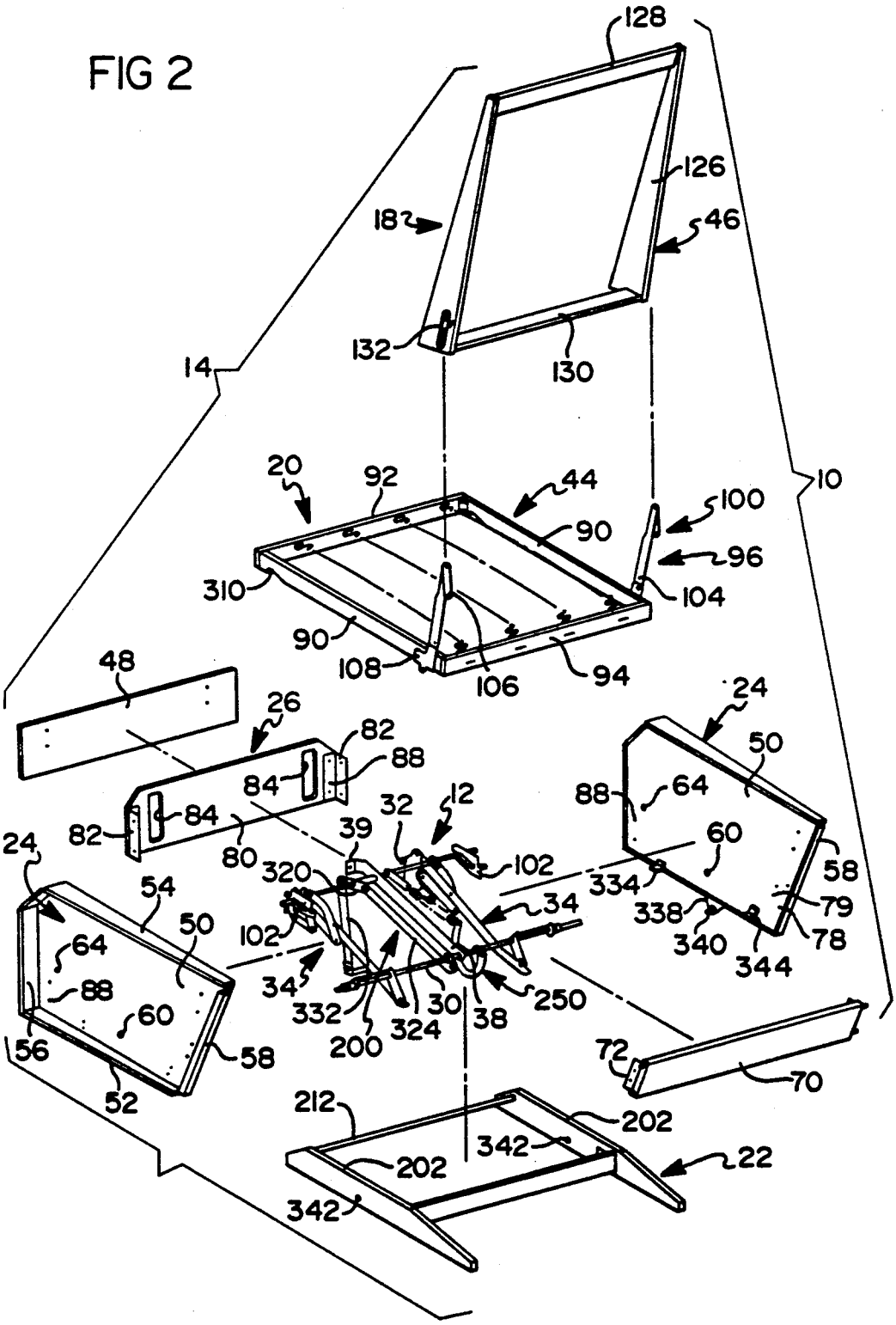
FIG. 2 is an exploded perspective view of a reclining chair of the type shown in FIG. 1 with upholstery, springs and other parts removed from the pre-assembled components for illustrating their integrated and interdependent association with an improved actuation mechanism.

In accordance with the teachings of the present invention, an improved actuation mechanism for use in single and multi-person articles of furniture (i.e. chairs and sofas or loveseats) is disclosed. In addition, the present invention is also directed to a method of assembling the improved actuation mechanism as a pre-assembled and "integrated" component of a reclining-type chair or the like. As will be described, the pre-assembled actuation mechanism is uniquely suspended in a "fixed" three-pivot-point arrangement from integral pre-upholstered box-like frame components so as to provide precise mechanical alignment and superior structural rigidity while concomitantly facilitating application of highly efficient fabrication and assembly processes.

The actuation mechanism of the present invention is a "three-way" mechanism which can be actuated to independently "recline" a seat back relative to a seat member or move a leg rest assembly between "retracted" and "extended" positions. Moreover, a full range of independent "reclining" movement of the seat back relative to the seat member is possible regardless of the operative position of the leg rest assembly between its fully "retracted" and "extended" positions.

In the disclosed embodiment, the article of furniture is shown as a combination recliner and tilt or lift chair, hereinafter referred to reclining/tilt chair 10, which includes a pre-assembled actuation mechanism 12 and various upholstered frame components that can be quickly and simply modularly assembled as a seating unit. Such "modular" construction provides a significant advancement over conventional furniture fabrication and assembly techniques since manipulation of heavy and cumbersome "unitized" chair frames during upholstery installation is no longer required. As such, each frame component or frame sub-assembly can be upholstered prior to modular assembly to actuation mechanism 12 so as to improve individual component quality as well as overall system quality and production efficiency. Moreover, since actuation mechanism 12 of the present invention is relatively compact in size, the use of loose upholstered cushions, which is an important feature in marketing various styles of chair, sofa or loveseat furniture, is also possible.

With particular reference now to the drawings, the functional and structural aspects of actuation mechanism 12, shown operably suspended from the various pre-upholstered box-like frame components of recliner/tilt chair 10, will now be described. More particularly, FIG. 1A depicts an exemplary combination reclining/tilt chair 10 having its seat assembly 14 shown in a fully "upright/non-tilted" position for permitting a seat occupant to enjoy conventional seating. FIG. 1B illustrates reclining/tilt chair 10 in the "upright/tilted" position with its associated leg rest assembly 16 shown protracted to its "extended" position.

As seen in FIG. 1C, seat assembly 14 includes a seat back 18 shown in a "reclined/non-tilted" position relative to a seat member 20 while leg rest assembly 16 is positioned in its retracted or "stowed" position. As is known, reclining movement of seat assembly 14 is accomplished by the seat occupant deliberately applying pressure to seat back 18 such that a seat swing mechanism causes seat member 20 to move forwardly and upwardly for maintaining seating comfort while the included angle increases therebetween. Chair 10 may be easily returned to its "upright" position upon deliberate application of rearward pressure to seat assembly 14 or, more simply, if the seat occupant leans forward to remove pressure from seat back 18. Finally, FIG. 1D shows seat assembly 14 of chair 10 in the "reclined/-tilted" position with its respective leg rest assembly 16 protracted to the "extended" position. In accordance with the embodiment shown, and as will be described in the following disclosure, the entire chair body 21 is readily "tilted" with respect to stationary base assembly 22 upon operation of the actuation handle 42.

In accordance with a primary design feature of the present invention, the various pre-assembled and upholstered frame components provided for operably suspending actuation mechanism 12 within reclining/tilt chair 10 will now be clearly described. For purposes of clarity, FIG. 2 shows the various pre-assembled frame components with their upholstery, padding, springs, etc. removed to better illustrate the interdependency of the frame components construction which can be rapidly and rigidly assembled in a relative easy and efficient manner. Therefore, all of the frame components can be individually fabricated or sub-assembled to include the requisite brackets, springs, padding and upholstery on an "off-line" batch-type basis. Thereafter, the various pre-assembled and upholstered frame components are assembled for totally integrating actuation mechanism 12 therein.

As seen in FIGS. 2 through 6, actuation mechanism 12 of reclining/tilt chair 10 is integrated into and operably suspended from left and right side frame assemblies 24. In addition to side frame assemblies 24, reclining/tilt chair 10 also includes front and rear rail assemblies 26 and 28, respectively, which when interconnected define a rigid "box-like" chair frame. As will be described in greater detail hereinafter, actuation mechanism 12 is pre-assembled to include a drive rod 30 and front support shaft 32, both of which are spatially oriented to be precisely located and "suspended" from left and right side frame assemblies 24.

With continued reference to FIGS. 2 through 6, actuation mechanism 12 is shown to support leg rest assembly 16 thereon. More specifically, leg rest assembly 16 includes left and right pantograph linkage mechanisms 34 and a spring-assisted toggle mechanism 36 which are operably associated with drive rod 30 and front support shaft 32 for permitting the seat occupant to selectively actuate leg rest assembly 16. A rigid cross-brace 38 is secured between drive rod 30 and support shaft 32 for providing structural rigidity within actuation mechanism 12. One end of cross-brace 38 is journally supported on drive rod 30 while the opposite end thereof is configured as a bracket 39 which is fixedly secured (such as by a suitable threaded fastener) to an inner surface of front rail assembly 26. Furthermore, support shaft 32 is fixed to an intermediate portion of cross-brace 38 via a spacer clip 40 to inhibit rotation of support shaft 32 upon rotation of drive rod 30. Spacer clip 40 also serves to locate support shaft 32 relative to side frame assemblies 24. In the preferred construction, drive rod 30 is an elongated square shaft having a handle portion 42 provided adjacent an upholstered exterior portion of one of side frame assemblies 24 that can be easily reached by a person seated in chair 10 for convenient actuation thereof.

As best seen in FIG. 2, most of the structural frame components such as side frame assemblies 24, front rail assembly 26, rear rail assembly 28, seat frame 44, seat back frame 46 and leg rest frame board 48 are each constructed in a manner which enables them to support springs, padding, upholstery, etc. in order to complete a decorative and stylish reclining/tilt chair 10 similar to that shown in FIGS. 1A through 1D. Preferably, each of these frame components is fabricated from one or more wood panels and/or rails that are fixedly secured together by suitable fasteners, such as dowels, staples, nails and screws, and which may be reinforced at critical joints by metal reinforcement plates or brackets and/or wood corner blocks in a known manner. As previously noted, each frame component is individually pre-assembled for subsequent assembly into a modular chair 10. However, it is to be understood that the specific construction shown for each frame component is merely exemplary in nature.

Left and right side frame assemblies 24 are each constructed as rigid, roughly rectangular frame components having a universal side panel 50 and horizontal bottom and top members 52 and 54, respectively, with top members 54 also functioning as chair arms. Each side frame assembly 24 also includes a front post 56 which preferably has at least a lower portion substantially perpendicular to the floor. In addition, each side frame assembly 24 has an inclined rear post member 58 such that front and rear posts 56 and 58, respectively, and top and bottom horizontal members 54 and 52, respectively, are each rigidly secured to a side panel 50. Moreover, side panels 50 have a first set of aligned bores 60 formed therein that are sized to receive opposite ends of drive rod 30. In addition, sleeve journals 62 are retained within bores 60 and are sized to permit rotation of drive rod 30. As such, aligned bores 60 define a first set of "fixed" pivot or suspension points that are seated directly within side panels 50. In this manner, drive rod 30 has a fixed pivot arrangement and not a conventional "floating" type which typically required additional linkages.

Side panels 50 also include a second set of aligned bores 64 oriented to receive opposite ends of support shaft 32 therein. As previously noted, spacer clip 40 positively locates rigid cross-brace 38 with respect to support shaft 32 for maintaining the desired rotation and "side-to-side" positioning of support shaft 32. As such, aligned bores 64 are seated directly in side panels 50 to define a second set of "fixed" pivot or suspension points. Since the first and second sets of aligned bores 60 and 64, respectively, are oriented in a predetermined arrangement on side panels 50, it is apparent that all critical hole locations for left and right side panels 50 may be drilled in a single operation. Therefore, pre-assembly of actuation mechanism 12 facilitates "final" assembly of chair 10 since drive rod 30 and support shaft 32 are oriented and retained (via cross-brace 38) for receipt within aligned bores 60 and 64, respectively. Side panels 50 do not become "left" or "right" until the members 52, 54, 56, and 58 are affixed, and sleeve journals 62 are installed in aligned bores 60, and T-nuts are inserted within bores 79 (described below). By thus providing side panels 50 as a universal component, the accuracy of locating aligned bores 60 and 64 is greatly enhanced.

With continued reference to the exploded perspective view of FIG. 2, means for rigidly securing front and rear rail assemblies 26 and 28, respectively, to side frame assemblies 24 for integrally suspending actuation mechanism 12 within a rigid "box-like" chair frame is disclosed. More particularly, rear rail assembly 28 includes a laterally extending cross-member 70 and left and right angled brackets 72 secured to the inner face surface thereof. One or more locator pins or dowel pins 76 provided on the opposite ends of cross-member 70 are adapted to be inserted into corresponding sets of aligned locator holes 78 formed in side panels 50 for properly locating rear rail assembly 28 with respect to side frame assemblies 24. Thereafter, suitable fasteners are used for fixedly securing angled brackets 72 and, in turn, rear rail assembly 28 directly to the inner surface of side panels 50. Preferably, T-nuts are retained within bores 79 formed in side panels 50 for receiving threaded fasteners therein to rigidly secure rear rail assembly 28 between the left and right side frame assemblies 24. Typically, an upholstered rear "tailgate" (not shown) is stapled to rear cross-member 70 since cross-member 70 is not generally upholstered.

Front rail assembly 26 includes a laterally extending planar front cross-member 80 and angled brackets 82 that are secured in close proximity to its opposite lateral ends. As will be appreciated, front cross-member 80 includes enlarged apertures 84 which are sized to permit leg rest pantograph linkages 34 to move therethrough during extension and retraction of leg rest assembly 16. In addition, front cross-member 80 is upholstered prior to assembly between side frame assemblies 24. Angled brackets 82 include non-threaded bores 86 which are alignable with bores 88 formed in side panels 50 and cross-member 80 to permit front rail assembly 26 to be rigidly secured between left and right side frame assemblies 24. In a preferred construction, suitable self-tapping threaded fasteners are used which are inserted from the outside.

Front cross member 80 is considerably deeper in top to bottom dimension than front mechanism frame members utilized in many conventional recliner chairs. Whereas the latter may have a top to bottom dimension ranging from approximately ¾ inch to 1½ inches, the front cross member 80 has a corresponding dimension of approximately 8 inches at its lateral ends. This increased dimension provides a substantially broader surface for connection of the front rail assembly 26 to side frame assemblies 24. When assembled, this increased lateral connection surface and box-like construction results in a very rigid chair frame. In addition, the enlarged connection surface enhances the rigidity of the chair arms thereby significantly reducing any deflection of the arms due side-to-side pressure applied thereagainst. Undesirable amounts of such deflection are common in prior known recliner chairs in which the minimal connection surface between the chair arms and the front member of the mechanism frame acts like a "pivot" or "point" type connection.

For additional structural frame rigidity and to eliminate any potential for squeaking between frame components, rear rail assembly may also be glued to side frame assemblies 24 (in addition to the use of conventional fasteners). In carrying out this step, glue is applied between dowel pins 76 and locator holes 78 of side frame assemblies 24. Even when the rear rail assembly 28 of chair 10 is glued to side frame assemblies 24, front rail assembly 26 can still be readily disassembled from side frame assemblies 24 for servicing actuation mechanism 12 in a conventional fashion should the need arise. To accomplish such disassembly the fasteners securing angled brackets 82, cross-member 80 and side frame assemblies 24 together are removed and side frame assemblies 24 flexed apart enough to permit support shaft 32 to be removed from the aligned bores 64. The various components of actuation mechanism 12 suspended from support shaft 32 are then removed by removing the spacer clips 40 and 41 and sliding the shaft 32 away from the components. If it is necessary to service the drive rod 30 or any of the components of actuation mechanism 12 suspended therefrom, drive rod 30 can be removed from the actuation mechanism by removing spacer clip 40 and sliding the drive rod laterally away from chair 10 through one of aligned bores 60. When the service work on chair 10 is completed, actuation mechanism 12 is reassembled by threading drive rod 30 through one of aligned bores 60 and the various actuation mechanism components that are to be suspended therefrom until drive rod 30 is journally situated and aligned in both aligned bores 60. Spacer clip 40 is then reinserted. In similar fashion, support shaft 32 is threaded through the various actuation mechanism components that are to be suspended therefrom until the ends are positioned in the aligned bores 64 and the spacer clips are reinserted. The cross-member 80 is then re-secured to side assemblies 24 via angled brackets 82 and fasteners as described above.

As best seen in FIGS. 2 and 3, seat frame 44 is located between and supported for reclining movement on side frame assemblies 24. More specifically, seat frame 44 is a rigid rectangular structure having left and right side bars 90 which are rigidly secured to opposite ends of front and rear cross pieces 92 and 94, respectively. In view of the compact nature of actuation mechanism 12, seat frame 44 is non-contoured (i.e. "flat") which also permits use of loose cushions, if desired. Seat frame 44 is supported for movement relative to side frame assemblies 24 by means of a seat swing mechanism 96 for causing seat frame 44 to move substantially horizontally and slightly up or down, depending on whether seat frame 44 moves forwardly (during "reclining" movement) or rearwardly (on return to the "upright" position). Seat swing mechanism 96 includes left and right hand rear swing linkages 100 and left and right hand front slide brackets 102. Rear swing linkages 100 extend vertically well above the level of seat frame 44 along rear posts 58 of side frame assemblies 24. Each rear swing linkage 100 includes an elongated swing link 104, a support bracket 106 and a seat bracket 108. An upper end of each swing link 104 is pivotably connected just below chair arm 54 to support bracket 106 which, in turn, is fixedly secured to its corresponding side panel 50. As such, pivot points 110 between swing links 104 and support brackets 106 define a third set of "fixed" pivot or suspension points that are seated directly in side panels 50.

The lower end of each rear swing link 104 is pivoted about a pivot point 112 to an upstanding post section 114 of seat bracket 108. Seat bracket 108 has a horizontal flange portion that is securely fixed (such as by wood screws) to an underside surface of a seat side bar 90 in relatively close proximity to the back end of seat frame 44. As such, loading on the rear of seat frame 44 passes from seat brackets 108 and pivots 112 into rear swing links 104 as tension loading which is transferred by way of pivots 110 and support brackets 106 into side frame assemblies 24 of chair 10. Rear swing links 104 are elongated to provide increased leverage for balanced reclining action. Thus, the rear of seat frame 44 moves much like a controlled pendulum on and below upper pivots 110. Accordingly, seat 20 can be pre-assembled and upholstered prior to final assembly. While not considered necessary to provide superior balanced comfort, left and right tension springs (not shown) may be installed between seat bracket 108 and a rearward stationary chair frame component to provide augmented resistance to reclining movement of seat assembly 14 for heavier seat occupants.

As mentioned, seat swing mechanism 96 also includes a pair of (i.e. left and right) front slide brackets 102 which are operable to guide and limit fore and aft movement of seat frame 44 and, in turn, seat 20. More particularly, front support shaft 32 extends through lost-motion slots 116 formed in left and right slide brackets 102 which have horizontal flanges 118 securely fixed (such as by wood screws) to an underside surface of seat side bars 90 in relatively close proximity to the front end of seat frame 44. In addition, slide brackets 102 also include elongated vertical flanges 119 which are adapted to be retained against the inner side surface of seat side bars 90.

As will be appreciated, the angularity and length of slots 116 define the range of fore and aft movement of seat frame 44 relative to chair body 21 upon the seat occupant applying a force to move seat assembly 14 between the "upright" and "reclined" positions. In addition, means are also provided for generating a predetermined amount of frictional drag upon movement of seat frame 44 with respect to support shaft 32. In particular, a nylon insert 120 is fixedly retained within lost-motion slots 116. Compression springs 122 are provided which concentrically surround opposite ends of support shaft 32 for biasing a disk-like washer 124 into frictional engagement with an inner surface of nylon insert 120 adjacent slot 116. Nylon insert 120 is operable for minimizing friction resistance to movement of the front end of seat assembly 20 with respect to support shaft 32 while concomitantly acting to effectively dampen noise. Left and right spacer clips 40 are provided for pre-loading springs 122 and for positively locating and retaining pantographic leg rest linkages 34 on support shaft 32. Therefore, slide brackets 102, inserts 120, washers 124, springs 122 and spacer clips 40 are pre-assembled onto support shaft 32.

Seat back 18 is constructed to include seat back frame 46 that is in the form of a rigid relatively rectangular assembly. Seat back frame 46 includes right and left hand side members 126 and upper and lower cross-pieces 128 and 130, respectively. As is known, seat back frame 46 can be removably mounted on an upper portion of rear swing links 104 by means of slide brackets 132 secured at suitable locations on side members 126. A preferred construction of slide brackets 132 for this type of mounting is shown and described in U.S. patent application Ser. No. 07/621,239 filed Nov. 30, 1990, assigned to the common assignee of the present invention, the disclosure of which is expressly incorporated by reference herein. In general, slide brackets 132 are channel-shaped to provide an interior track that slidably receives rear swing links 104 therein. When slide brackets 132 are mounted on rear swing links 104, seat back 18 is, in effect, an extension of rear swing links 104 above pivot points 110. As such, seat back 18 can be pivoted about pivots 110 for acting as a lever arm for causing relatively easy angularly movement of rear swing links 104 and fore and aft movement of seat 20.

Leg rest assembly 16 is shown to include frame board 48 having an outer surface that is padded and upholstered so that finished reclining/rocking chair 10 will be as seen in FIGS. 1A through 1D. Frame board 48 is supported and moved by identical left and right hand pantograph linkages 34. Pantograph linkages 34 are substantially identical in function and structure to that shown in FIG. 3 of U.S. Pat. No. 3,096,121, assigned to the common assignee of the present invention, with the exception that pantograph linkages 34 are operably suspended about the second set of "fixed" suspension points defined by support shaft 32. For a better understanding of the operation of pantograph linkages 34, a brief description is included herein. More particularly, frame board 48 has an angled bracket 140 secured to its bottom face 144 for each pantograph linkage 34, whereby frame board 48 is pivotably connected at a rear pivot 146 and a front pivot 148 to one end of board links 150 and 152, respectively, of pantographs 34. The opposite end of front board link 152 is pivoted at 154 to an end of a connector link 156 which, in turn, is centrally pivoted at 158 to a portion of rear board link 150. The other end of connector link 156 is pivoted at 160 to a top end of a long support link 162. The other end of rear board link 150 is pivoted at 164 to one end of a curved link 166 which is pivoted at a central pivot 168 to a central portion of long support link 162. The other end of curved link 166 is pivotably connected at pivot 170 to front support shaft 32. As noted, left and right spring clips 40 are provided to maintain the desired spacing between left and right pantograph mechanisms 34 on support shaft 32.

Another point of support is pivot 176 at the curved bottom end of long support link 162 which connects support link 162 to a first end of a drive link 178, the other end of which has a square aligned hole through which square drive rod 30 extends such that drive link 178 is driven by angular movement of drive rod 30. Thus, selective rotation of drive rod 30 turns drive link 178 which acts through pivot 176 to move long support link 162. Such movement of support link 162 causes curved link 166 to swing about "fixed" pivot 170 by virtue of pivot connection 168 that curved link 166 has with long support link 162. The action of link 166 swinging about fixed pivot 170 acts to move rear board link 150 outwardly and upwardly. In addition, pivot 160 at the top end of long support link 162 causes connector link 156 to swing about pivot 158 such that front board link 152 is also moved outwardly and upwardly. This extensible action takes place simultaneously with both the left hand and right hand pantograph linkages 34 when there is sufficient angular rotation of drive rod 30 via handle 42. In this manner, frame board 40 is moveable between its "stowed" vertical position and its "extend" protracted position.

As best seen in FIG. 3, drive link 178 is generally U-shaped having parallel short and long legs 182 and 184, respectively, joined by a base portion 186 which overlies drive rod 30. Both legs 182 and 184 have square aligned holes through which square drive rod 30 extends. When leg rest assembly 16 is protracted to its fully "extended" position, a cold deformed stop tab 186 on long leg 184 contacts a stop shoulder 188 formed on the lower end of long support link 162 when long leg 184 and link 162 are almost in relatively collinear alignment. Due to engagement of stop tab 186 and stop shoulder 188, further extension of pantograph linkages 34 is inhibited such that leg rest frame 48 is held in an elevated and generally horizontal position.

To provide means for permitting the chair frame 21 to tilt relative to base assembly 22, a tilt mechanism 200 is provided as part of the preassembled actuation mechanism 12. As will be appreciated, tilt mechanism 200 is operable to permit balanced lifting of the front of chair body 21 with respect to fixed base assembly 22 without causing seat assembly 14 to recline inadvertently.

Tilt mechanism 200 is shown in FIGS. 3 through 6 to include a pivot lever 320 that is journalled at its mid-section for rotational or pivotal movement upon support shaft 32. The rear end of pivot lever 320 is pivotally connected at 322 to one end of a long push link 324. The other end of push link 324 is curved and pivotally connected at 326 to a short tilt drive link 328. Drive link 328 has a square aperture therein which receives square drive rod 30 such that drive link 328 is fixed for rotation with drive rod 30. The other or forward end of pivot lever 320 is pivotally connected at 330 to the upper end of a long lift link 332. The lower end of lift link 332 is pivotally connected at 334 to an angled lift link bracket 336. Lift link 332 includes a longitudinal rib 321 to provide structural rigidity and strength thereto. During assembly of the reclining/tilt chair 10, lift link bracket 336 is secured (as will be described further) by means of conventional threaded fasteners to the front rail of base assembly 22. More particularly, lift link bracket 336 has a flanged portion that includes a pair of apertures to facilitate connecting the bracket to corresponding apertures in the base assembly's front rail.

The pivot connection between the various links and members of the tilt mechanism 200 are similar to those of the pantograph linkage 34 of leg rest assembly 16. Each connection comprises a rivet projecting through mating apertures provided in the corresponding links. Between the two links a fiber washer is provided to reduce friction and a wave washer is provided between the head of the rivet and its adjacent link to reduce "play". In this fashion the linkages of the tilt mechanism 200 all freely move with respect to each other.

Figure 5:
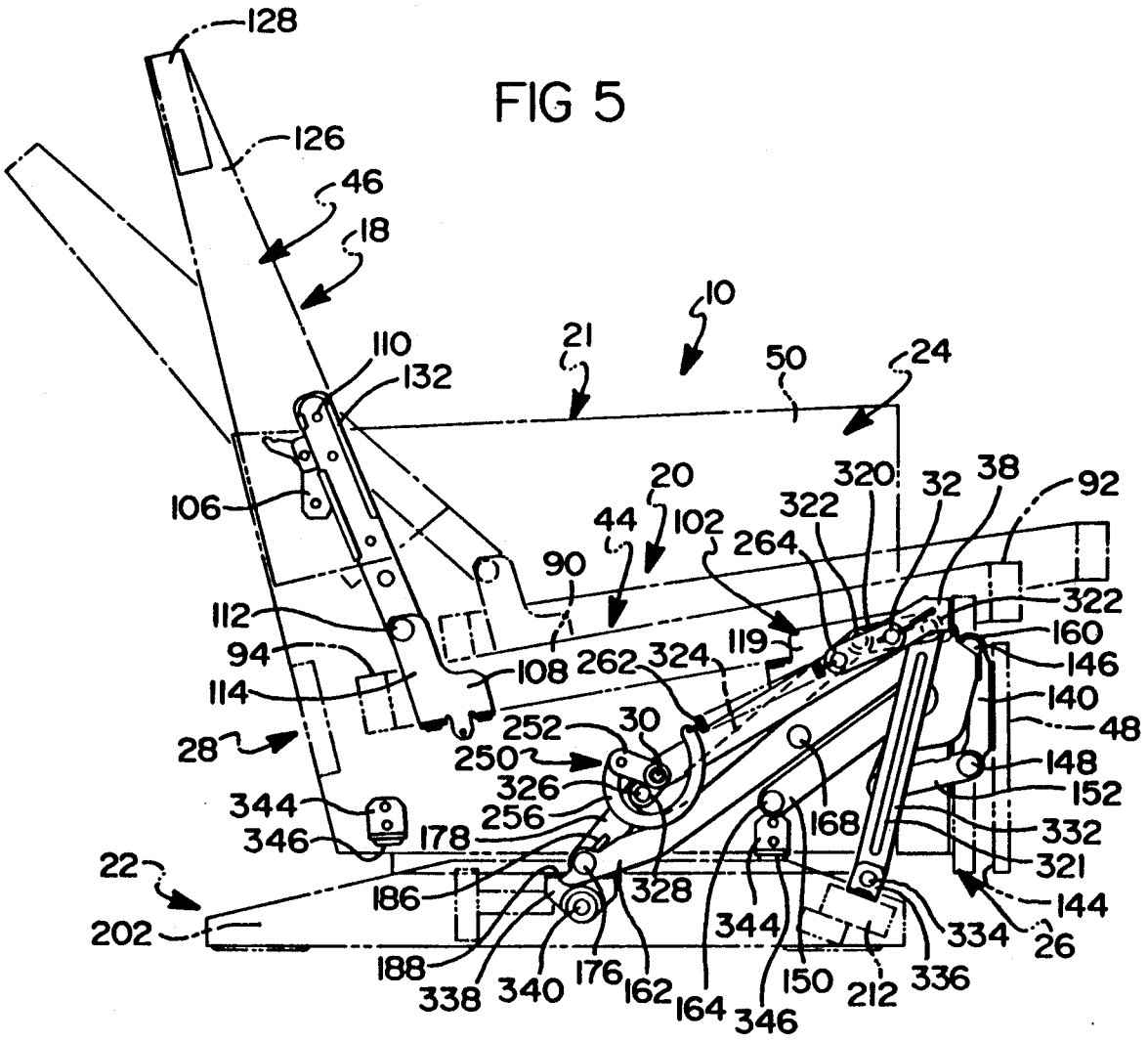
FIG. 5 is a sectional view, taken along line 5—5 of FIG. 4, illustrating the reclining chair in a "leg rest retracted/non-tilted" position.
Figure 6:
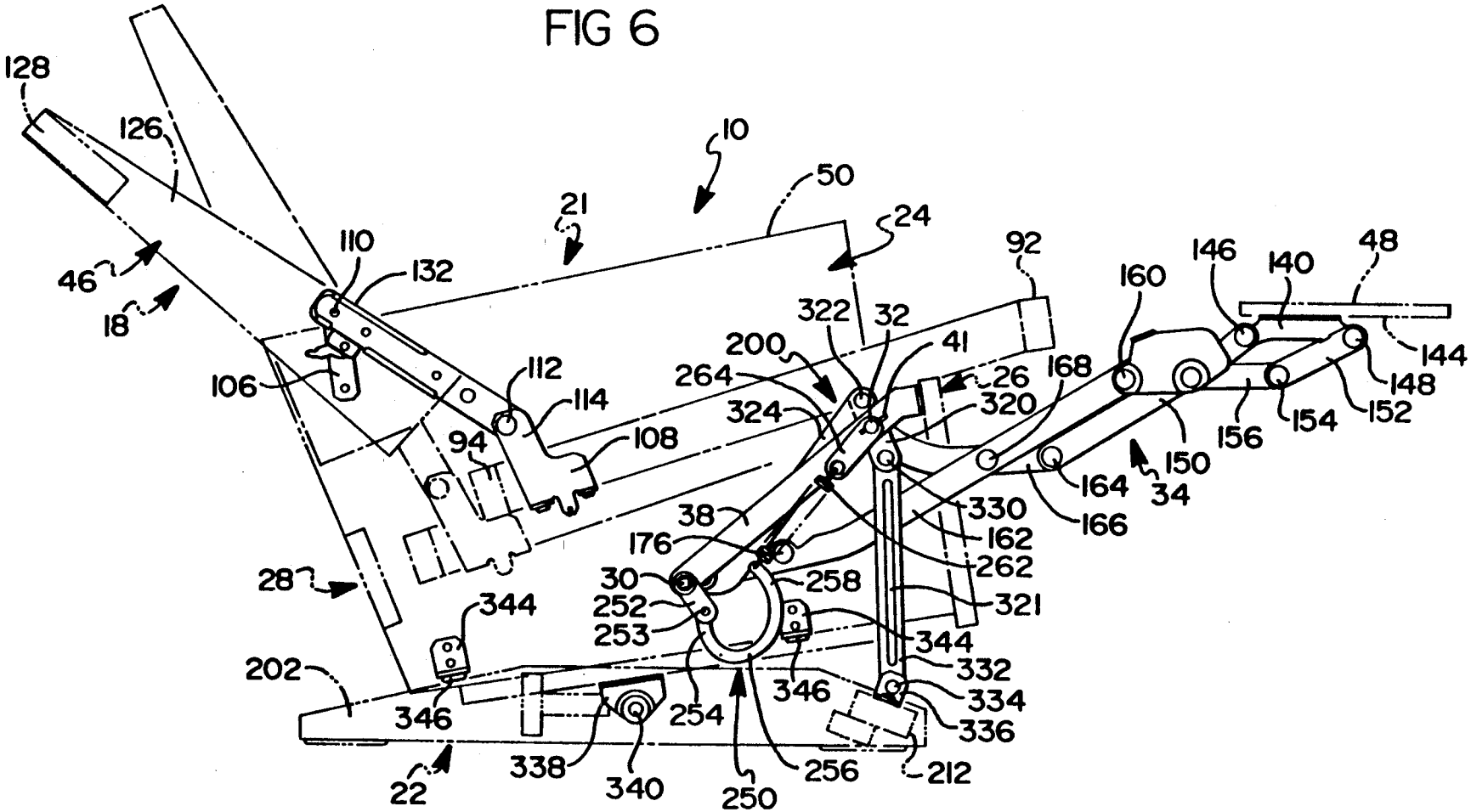
FIG. 6 is a view like FIG. 4, illustrating the chair in a "leg rest extended/tilted" position.

Reclining/tilt chair 10 also includes a pair of angled pivot brackets 338 that are securely fixed, such as by suitable threaded fasteners and T-nuts, to an underside surface of side frame assemblies 24 at a predetermined location. Preferably pivot brackets 338 are attached rearward of the center of the side frame assemblies as shown in FIGS. 5 and 6. The predetermined location of pivot brackets 338 is selected to be in close proximity to the center of gravity of the chair body frame 21 when it is occupied. More particularly, it is preferable that the pivot brackets 338 be located such that the center of gravity is just forward of the pivot brackets when the chair 10 is in its non-tilted position and as the chair is "tilted" or pivoted about pivot brackets 338, the center of gravity passes over pivot brackets and is located just behind them when the chair 10 is in its fully tilted position. Within these confines the relationship of the pivot brackets 338 relative to the center of gravity of chair frame 21 can be adjusted to affect the ease of operation of the chair 10. It will also be appreciated that changing the location of the pivot brackets will affect the angle of tilt of the chair. In a preferred embodiment of the present invention the pivot brackets 338 are located to permit the chair body 21 to be tilted upwardly at an angle of approximately 10 degrees when the chair is in the "tilted" position (i.e., the "non-tilted" position defining 0 degrees). If the pivot brackets 338 are moved forwardly along the underside surface of side frame assemblies 24, the tilt angle will increase. Conversely, if the pivot brackets are moved rearwardly, the tilt angle will decrease.

Pivot brackets 338 each include a flange portion having a pivot aperture which is adapted to receive a clevis pin 340. Clevis pins 340 pivotally mount chair frame 21 upon base assembly 22 when they are inserted through the pivot aperture into a mounting aperture 342 that is provided at a predetermined location along the base side rails 202 of base assembly 22. Mounting apertures 342 are axially aligned along side rails 202 to correspond with pivot brackets 338. Base assembly 22 is further positioned relative to chair frame 21 to provide adequate stability in all directions. Nylon inserts (not shown) to reduce pivoting friction are provided within mounting apertures 342 and retention means such as a speed nut or the like is utilized to retain clevis pin 340 within mounting apertures 342.

Tilting mechanism 200 is actuated upon angular movement of drive rod 30. In general, tilting mechanism 200 acts between front support bar 32 of actuation mechanism 12 and forward cross-rail 212 of base assembly 22 for increasing the distance therebetween and thus lifting the front of the chair body 21 relative to base assembly 22. Since chair body 21 is pivotally connected to the base assembly 22 by virtue of pivot brackets 338, clevis pins 340 and mounting apertures 342, chair body 21 pivots or "tilts" on the axis that is defined by clevis pins 340 when the front of the chair body 21 is "lifted". Such lifting of support shaft 32 takes place as tilt drive link 338 is rotated by actuation of the drive rod 30 to decrease the distance between pivot 326 (which connects drive link 338 and push link 324) and pivot 330 (which connects pivot lever 320 and lift link 332). As shown in FIGS. 5 and 6, pivot lever 320, which is in a substantially horizontal orientation when the reclining/tilt chair 10 is in its "non-tilted" (i.e., "leg rest retracted") position, pivots in a clockwise direction about pivot 330 as drive rod 30 is rotated and the chair 10 is moved to its "leg rest extended" position. As pivot lever is rotated about and above pivot 330 (which is "fixed" via lift link 332 and lift link bracket 336 relative to base assembly 22) support shaft 32 is "lifted" thus causing the chair body 21 to "tilt" or pivot in a counterclockwise direction about the axis defined by clevis pins 340.

When the drive rod 30 is rotated in a clockwise direction (by rotation of actuator handle 42 in a forward direction) to stow the leg rest assembly 16 in its retracted position, corresponding rotation of tilt drive link 328 is caused which, in turn, causes pivot 326 to be moved rearwardly. As this happens, the distance between tilt mechanism pivots 330 and 326 is increased thereby swinging pivot lever 320 about pivot 330 in a counterclockwise direction. This movement of pivot lever 320 lowers support shaft 32, and therefore the front of chair body 21, until the leg rest assembly 16 is fully retracted and the chair once again assumes its "non-tilted" position or orientation. A pair of flanged stop brackets 344 are provided in predetermined fore and aft positions along the bottom of each side frame assembly 24. Rubber bumpers 346 are provided on the bottom of the flanged portion of each of the stop brackets 344 to contact the top of side rails 202 of the base assembly 22 when chair 10 is in its respective "tilted" and "non-tilted" positions. In this manner, the "play" due to the tolerances designed into the pivot connections of the tilt mechanism 200 is resiliently absorbed and the chair body becomes rigidly stationary in both positions through a predetermined preload on the rubber bumpers 346. This preload is determined by the height and durometer of the bumpers 346, the position of the stop brackets 344 and tilt mechanism 200.

As best seen in FIGS. 3 and 4, spring-assist toggle assembly 250 is provided which works coactively with leg rest pantograph linkages 34. Toggle assembly 250 provides means for securely holding frame board 48 of leg rest assembly 16 in a fully retracted position against front rail assembly 26. Toggle assembly 250 is also operable to supply a spring force for biasingly urging leg rest assembly 16 toward one of its extended and retracted positions. More particularly, toggle assembly 250 includes a toggle lever 252 with a square hole which is mounted by means of the square hole on square drive rod 30 for rotation therewith. Toggle lever 252 is pivotally connected at pivot 253 to rear leg 254 of a C-shaped toggle link 256 that curves around, under and toward the front of drive rod 30 where its front leg 258 has an opening to which one end of a helical coil spring 262 is attached. The opposite end of spring 262 is attached to a spring connection link 264 which is journally secured by means of a circular aperture to support shaft 32. In this manner, toggle assembly 250 can be completely preassembled as part of actuation mechanism 12. While not shown, tension adjustment means may be optionally provided for adjusting the tension in spring 262. For example, the tension in spring 262 can be adjustably relieved for a lighter weight occupant or it can be increased for a heavier seat occupant. The spring connection link 264 of toggle assembly 250 is positively located on support shaft 32 by means of a spacer clip 41 for maintaining the desired spacing of toggle assembly 250 from tilt mechanism 200 and pantograph linkages 34 in order to avoid interference therewith. As shown in FIGS. 3 and 4, the same spacer clip 41 also positively locates cross-brace 38 and prevents support shaft 32 from rotating relative thereto. An additional spacer clip 40 also positively locates tilt drive link 328 and cross brace 38 in their desired positions along drive rod 30. Pivot lever 320 of tilt mechanism 200 is positively located in its predetermined position along support shaft 32 by means of a spacer tube 350 and a cotter pin 352.

Operation of toggle assembly 250 will now be described in greater detail. The location of pivot 253 above drive rod 30 and the line of action of spring 262 are such that in the retracted position of leg rest assembly 16, the spring force acts to biasingly hold or "retain" leg rest assembly 16. As leg rest 16 is initially extended upon slight rotation of actuator lever 42 and, in turn, drive rod 30, pivot 253 moves down and over center of an imaginary line between the axis of the support shaft 32 and the drive rod axis. Once pivot 253 is over-center, tension loading on spring 262 assists in drivingly rotating drive rod 30 for elevating leg rest assembly 16 as forward leg 258 of link 256 is pulled toward spring connection link 264 and support shaft 32. In addition, spring 262 assists the seat occupant in pivoting handle 42 through the required actuation angle. In similar fashion, toggle assembly 250 is adapted to utilize the spring biasing force of spring 262 to assist in returning leg rest assembly 16 to its stowed position upon reverse rotation of handle 42.

In accordance with the principles of the present invention, a unique method for assembling the various "modular" pre-assembled frame components and actuation mechanism 12 into reclining/tilt chair 10 will now be described in greater detail. In addition, the improved method of the present invention permits sequential assembly of the pre-assembled and/or upholstered components in a simple and efficient manner for significantly reducing overall system complexity, weight, and cost while promoting superior quality and reliability.

Figure 7A:
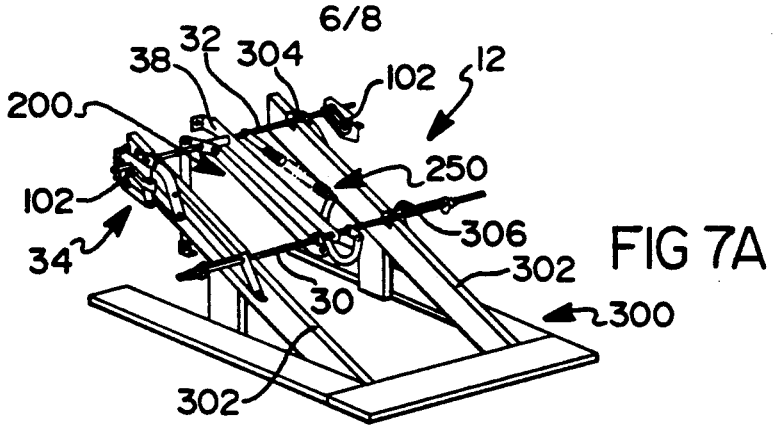

With particular reference now to FIG. 7A, pre-assembled actuation mechanism 12 is shown retained on a suitable holder or "jig" 300. Jig 300 includes a pair of spaced and angularly extending stantions 302 having first and second sets of aligned notches 304 and 306, respectively. As can be seen, the first set of aligned notches 304 is provided for retaining support shaft 32 therein while the second set of aligned notches 306 is provided for retaining drive rod 30 therein. As previously noted, the various components associated with slide brackets 102, pantograph linkages 34, tilt mechanism 200, cross-brace 38, and toggle assembly 250 are all operably coupled to, or suspended from, actuation mechanism 12 prior to interconnection with the various frame components. Alternatively, jig 300 may be used as an appropriate situs for assembling the various linkages and components associated with actuation mechanism 12.

Figure 7B:
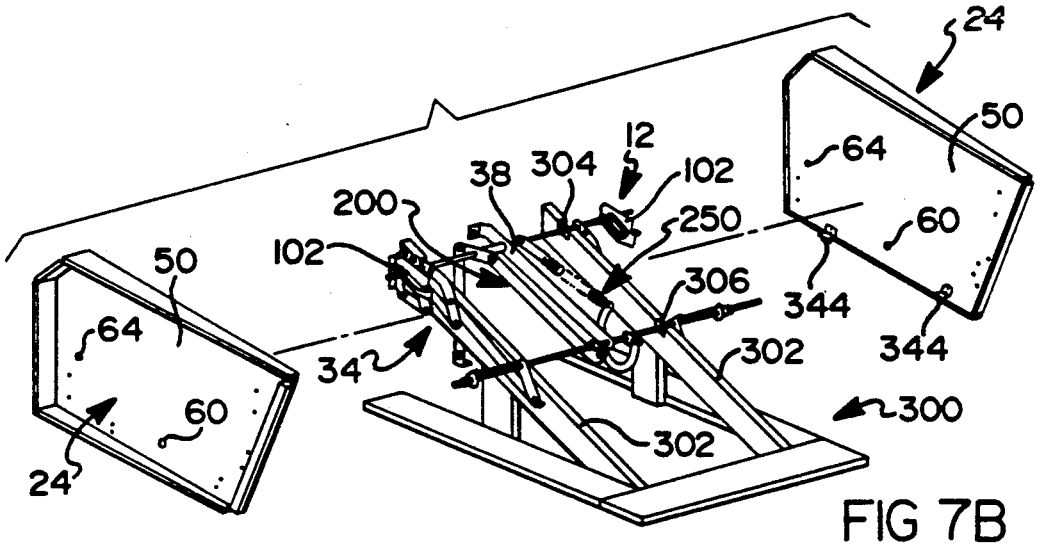

With reference now to FIG. 7B, the assembly step for orienting and interconnecting side frame assemblies 24 with actuation mechanism 12 is clearly shown. As will be appreciated, side frame assemblies 24 have been pre-assembled to include pivot brackets 338 and stop brackets 344. Alternatively, as disclosed below, pivot brackets 338 may be preassembled as part of base assembly 22. While not shown, it is to be understood that the requisite padding, lining, decorative upholstery and the like have also been installed on side frame assemblies 24 prior to assembly with actuation mechanism 12. As seen, drive rod 30 and support shaft 32 are of sufficient length such that side frame assemblies 24 can be retained thereon. More specifically, the upholstered side frame assemblies 24 are positioned on actuation mechanism 12 such that the opposite ends of drive rod 30 extend through the first set of aligned bores 60 formed in side panels 50 (i.e. the first set of "fixed" pivot points). Similarly, the opposite ends of support shaft 32 are seated with the second set of aligned bores 64 formed in side panels 50 (i.e. the second set of "fixed" pivot points).

Figure 7C:
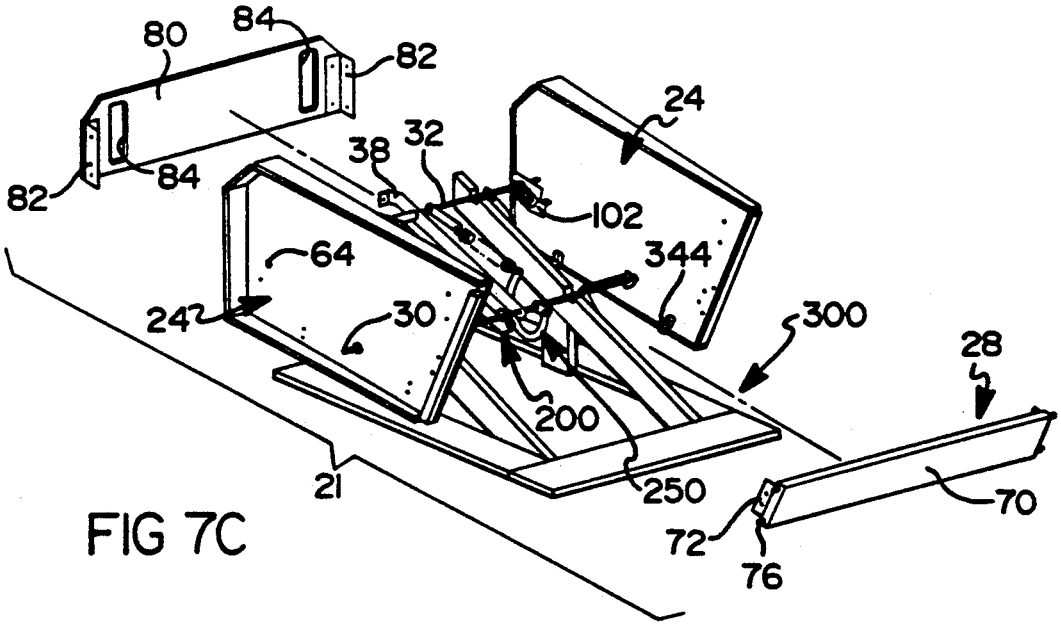

As seen in FIG. 7C, the four primary pre-assembled frame components include left and right side frame assemblies 24 and front and rear rail assemblies 26 and 28, respectively. In accordance with a preferred assembly procedure, dowel pins 76 on opposite ends of rear cross-member 70 are inserted with glue into locator holes 78 formed in side panels 50 for properly aligning and locating rear rail assembly 28 with respect to the left and right side frame assemblies 24. Thereafter, threaded fasteners are threadably driven through bores in angled bracket 72 and into T-nuts retained within bores 79 formed of side panels 50 for securing rear rail assembly 28 between the left and right side frame assemblies 24. Complete tightening of the threaded fasteners is typically deferred until front rail assembly 26 has also been secured to side frame assemblies 24. As noted, an upholstered "tailgate" (not shown) may be secured to rear rail assembly 28 in those applications wherein rear rail assembly 28 is not upholstered.

Following interconnection of rear rail assembly 28, the front rail assembly 26 is slid inwardly between left and right side frame assemblies 24 in such a manner to permit portions of pantograph linkages 34 to project through apertures 84 formed in front cross-member 80. As shown in FIG. 7C, angled brackets 82 have been pre-assembled to the rear surface at the laterally outer ends of front cross-member 80. In addition, front cross-member 80 has been upholstered prior to assembly. Self-tapping fasteners are threadably driven through tight bores 88 formed in side panels 50 into non-threaded bores 86 formed in angled brackets 82 for rigidly securing front rail assembly 26 to side frame assemblies 24. Thereafter, cross-brace bracket 39 is securely attached to front cross-member 80 to provide additional structural rigidity.

FIG. 7D illustrates the integrated and interdependent relationship of the four primary frame components which, when assembled, define an extremely rigid "box-like" upholstered chair body 21 within which actuation mechanism 12 is suspended. As noted, this "integrated" construction permits the elimination of the separate mechanism frame assembly conventionally provided for supporting the actuation mechanisms in prior known reclining chairs. As seen, jig 300 is designed to permit the various frame components to be interconnected in an extremely efficient manner. Following assembly of chair body 21, frame board 48 is fixedly secured to angled brackets 140 of pantograph linkages 34. Again, it is to be understood that frame board 48 has been pre-assembled as an upholstered unit prior to being assembled as part of chair body 21.

With particular reference now to FIG. 7E, the four pre-assembled frame components defining chair body 21 are shown supported from jig 300 with actuation mechanism 12 integrally suspended therefrom. In accordance with the next operation, upholstered seat 20 (which includes seat frame 44 with its appropriate upholstery padding and springs) is interconnected to chair body 21. More particularly, notches 310 formed in the front underside edges of seat frame side bars 90 are provided for aligning seat frame 44 with respect to support shaft 32. Next, rear swing linkages 100, which have been pre-assembled onto upholstered seat 20, are fixedly secured to side panels 50 via support brackets 106. Once support brackets 106 are fixedly secured to side panels 50 (via suitable fasteners), pivot points 110 between swing links 104 and support brackets 106 are operable to define the third set of "fixed" pivot points about which seat assembly 14 is reclinable. Alternatively, support brackets 106 of rear swing linkages 100 can be initially mounted directly to side panels 50 such that angled brackets 108 can be thereafter secured to upholstered seat 20. In this manner, seat 20 can be "flipped over" to permit seat brackets 108 to be securely fastened to side bars 90 of seat frame 44. With seat frame 44 positioned such that support shaft 32 is located in notches 310, slide brackets 102 are pulled inwardly against the biasing force of springs 122 until vertically extending flanges 119 abuttingly engage the inner surface of seat frame side bars 90. Thereafter, suitable fasteners (such as wood screws) are driven through holes in horizontal flanges 118 to securely fix slide brackets 102 to an underside surface of seat side bars 90.

Figure 7G:
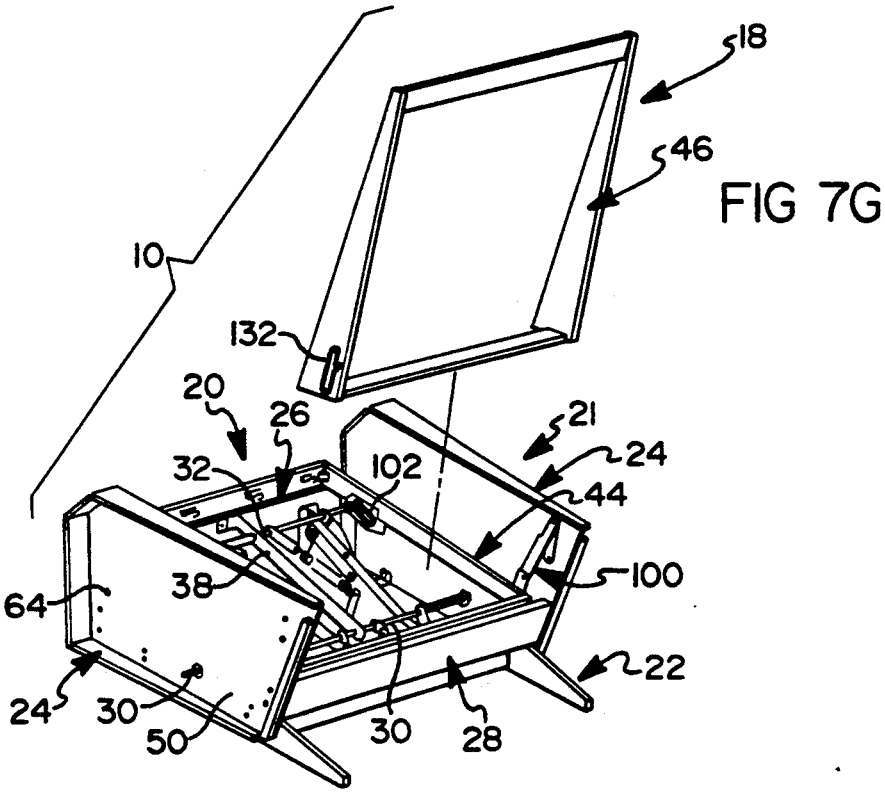
Figure 7H:
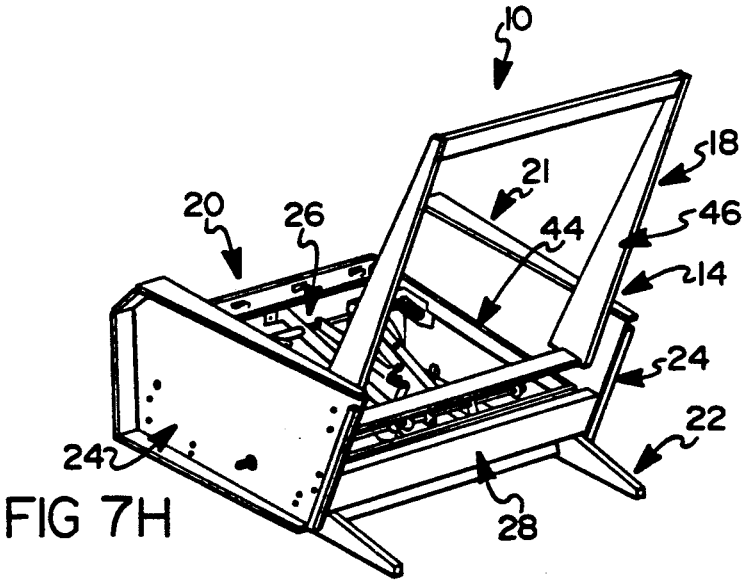

With particular reference now to FIG. 7F, base assembly 22 is shown pre-assembled and includes bores provided in front cross-rail 212 for attaching lift link bracket 336 and mounting apertures 342 provided in side rails 202 of base assembly 22. Chair body 21 is removed from jig 300 and lift link bracket 336 is attached to front rail 212 of base assembly 22 with suitable fasteners at the bores provided therein to complete the operative assembly of tilt mechanism 200. Preferably this is accomplished by setting chair body 21 in an upside down position on its arms and orienting base assembly 22 relative thereto. After lift link bracket 336 is attached, base assembly 22 is placed in proper alignment with chair body 21 such that mounting apertures 342 are aligned with the apertures in pivot brackets 338. Thereafter, clevis pins 340 are inserted through said pivot brackets and said mounting apertures 342 and retained therein with suitable fasteners. In this manner, chair body is pivotally connected for "tilting" movement with respect to base assembly 22. Alternatively, lift link brackets 336 can be pre-mounted to base assembly 22 via clevis pins 340 and then attached to the underside surface of side frame assemblies with threaded fasteners after assembly of the chair body has been completed. Finally, FIGS. 7G and 7H illustrate the manner in which upholstered seat back 18 can be detachably secured to seat 20 via swing links 104 and slide brackets 130.

As is relatively apparent from examination of FIGS. 7A through 7H, the pre-assembled components can be interconnected in a number of other acceptable sequential operations to produce "knock-down" or modular chair 10. The method of assembly disclosed herein is advantageous in that virtually all of the components can be pre-assembled "off-line" for quick and efficient modular interconnection in a highly repeatable and precise fashion.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for assembling a reclining/tilt chair having a stationary base comprising:

providing means defining a chair frame having side frame members interconnected with cross rail members;

suspending an actuation mechanism between said side frame members;

pivotally interconnecting a seat and seat back;

operably connecting said interconnected seat and seat back to said chair frame for reclining movement; and attaching said chair frame to said base along a lateral horizontal axis for pivotal movement of said chair frame relative to said base about said axis, said actuation mechanism operable to tilt said chair frame rearwardly on said horizontal axis relative to said base.

2. The method of claim 1 further comprising:

connecting said seat to said actuation mechanism for guiding the longitudinal movement of said seat in response to said reclining movement of said seat assembly.

3. The method of claim 1 wherein said step of suspending said actuation mechanism comprises:

providing alignment means associated with said side frame members for aligning said actuation mechanism; and aligning said actuation mechanism to said alignment means.

4. The method of claim 3 wherein said actuation mechanism includes first and second shafts, said alignment means comprises a first and second set of bores formed in said side frame members, and said step of aligning said actuation mechanism comprises:

inserting opposite ends of said first shaft within said first set of alignable bores; and inserting opposite ends of said second shaft within said second set of alignable bores.

5. The method of claim 4 further comprising:

providing swing link means for pivotally interconnecting said seat to said seat back; and connecting said swing link means to said side frame members for suspending said seat assembly therebetween, said swing link means operable to permit reclining movement of said seat assembly with respect to said chair frame between an upright position and a reclined position.

6. The method of claim 5 wherein said step of connecting said swing link means to said side frame members comprises:

providing alignment means associated with said side frame members for aligning said swing link means therebetween; and aligning said swing link means to said alignment means.

7. The method of claim 6 wherein said alignment means comprises a third set of alignable bores formed in said side frame member and said step of aligning said swing link means comprises:

connecting said swing link means to said third set of alignable bores;

providing guide means for guiding and limiting fore and aft movement of said seat with respect to said first shaft in response to reclining movement of said seat assembly; and connecting a frame portion of said seat to said guide means.

8. The method of claim 4 wherein one of said first and second shafts is a drive rod and said other of said first and second shafts is a support shaft, said method further comprising the step of:

operatively supporting tilt linkage means from said support shaft and said drive rod and connecting said tilt linkage means to said base for movement of said support shaft between a non-tilted position and a tilted position in response to selective rotation of said drive rod.

9. The method of claim 8 further comprising the step of operatively supporting a leg rest assembly from said support shaft and said drive rod for movement between a retracted position and an extended position in response to selective rotation of said drive rod.

10. The method of claim 9 wherein said leg rest assembly comprises linkage means and biasing means for retaining said leg rest assembly in said retracted position when said drive rod is rotated to a first position and in said extended position when said drive rod is rotated to a second position, said method further comprising the step of:

assembling said linkage means and said biasing means to said drive rod and support shaft prior to installation thereof within said chair frame.

11. The method of claim 8 further comprising the step of interconnecting said chair frame to said base so as to permit pivotable movement of said chair frame with respect to said base.

12. The method of claim 11 further comprising the step of interconnecting said tilt linkage means between said base assembly and said chair frame for selectively tilting said chair frame relative to said base when said drive rod is moved between said second position and said first position.

13. The method of claim 8 further comprising the steps of:

interconnecting said rigid chair frame to said base assembly so as to permit pivotable movement of said chair frame with respect to said base assembly, said pivotable movement being independent of said seat assembly, and interconnecting said tilt linkage means between said base assembly and said chair frame for selectively tilting said chair frame relative to said base assembly when said drive rod is moved between said second position and said first position.

14. The method of claim 1 further comprising the step of upholstering said side frame members and said cross rail members prior to interconnection into said chair frame.

15. A reclinable/tiltable seating unit including a pair of side frame members having at least three sets of alignable bores formed therein, a front cross frame member, a rear cross frame member, a mechanical actuation mechanism comprising a support shaft and a drive rod each transversely extending between said side frame members, a leg rest mechanism suspended from said support shaft and having a pair of pantograph linkages projecting through a pair of elongated apertures formed in said front cross frame member, a leg rest frame board, a tilt linkage assembly suspended from said support shaft and said drive rod, said tilt linkage assembly operable to permit tilting movement of said reclining seating unit relative to a stationary base assembly upon which said seating unit is pivotally supported, a seat assembly having a seat, a seat back, and swing link means for pivotally interconnecting said seat and seat back to said side frame members, said swing link means operable to permit reclining movement of said seat assembly between an upright position and a reclined position in response to pressure applied by a seat occupant to said seat back, guide means operable for guiding and limiting longitudinal movement of said seat with respect to said support shaft in response to reclining movement of said seat assembly, the improvement comprising assembling said reclinable seating unit by:

assembling said mechanical actuation mechanism to include said drive rod, said support shaft, means for rigidly interconnecting said drive rod and support shaft in a predetermined orientation, said pair of pantographic linkages and said tilt linkage assembly journally supported on said support shaft and drivingly coupled to said drive rod for movement of said pantograph linkages between a retracted position and an extended position and movement of said tilt linkage assembly between a non-tilted and a tilted position in response to selective rotation of said drive rod, and said guide means, said guide means comprising a pair of slide brackets having slot means formed therein through which opposite ends of said support shaft extend;

inserting opposite ends of said drive rod into a first set of said alignable bores for journally suspending said drive rod between said side frame members;

inserting opposite ends of said support shaft into a second set of said alignable bores for seating said support shaft between said side frame members;

interconnecting said cross frame members between front and rear portions of said side frame members to define a rigid chair body from which said mechanical actuation mechanism is integrally suspended;

connecting said swing link means to a third set of said alignable bores for suspending said seat assembly from said side frame members;

connecting said slide brackets to said seat member such that said slot means coact with said support shaft to guide and limit the longitudinal movement of said seat during reclining movement of said seat assembly;

mounting said leg rest frame board to said pair of pantographic linkages for movement thereof between said retracted and extended positions;

connecting said stationary base assembly to said side frame member of said rigid chair body for pivotal movement therebetween;

connecting a portion of said tilt linkage assembly to said base assembly; and coupling a manually-operable means to said drive rod for permitting said seat occupant to selectively rotate said drive rod for driving said pantographic linkages and said leg rest frame board between said retracted and extended positions and for simultaneously moving said chair body between said non-tilted and tilted positions.

16. A method of modular assembly for a tiltable chair, said method comprising the steps of:

providing an actuation mechanism having first and second shafts;

operable supporting a tilt linkage assembly between said shafts, said tilt linkage assembly providing means to tilt said chair about a horizontal axis upon selective actuation of said actuation mechanism;

providing a pair of side frame members;

inserting opposite ends of said first shaft into a first set of alignable bores formed in said side frame members for suspending said first shaft therebetween;

inserting opposite ends of said second shaft into a second set of alignable bores formed in said side frame members for suspending said second shaft therebetween;

connecting front and rear cross frame members between said side frame members to define a chair frame, said actuation mechanism being integrally retained within said chair frame;

providing a seat back and a seat member, and connecting said seat member and said seat back to said chair frame.

17. The method of claim 16 wherein said first shaft of said actuation mechanism is a front support shaft and said second shaft is a drive rod, said drive rod and said support shaft being rigidly maintained in a predetermined spatial arrangement to permit sliding insertion of the opposite ends thereof into said first and second sets of alignable bores formed in said side frame members, and wherein said drive rod is selectively rotatable with respect to said second set of alignable bores while said support shaft is inhibited from rotation within said first set of alignable bores in response to rotation of said drive rod.

18. The method of claim 17 further comprising the step of operably supporting a leg rest assembly between said support shaft and said drive rod, said leg rest assembly being moveable between a retracted position and an extended position in response to selective rotation of said drive rod.

19. The method of claim 18 wherein said leg rest assembly includes a leg rest frame board and pantograph linkage means journally suspended on said front support shaft and drivingly coupled to said drive rod for moving said leg rest frame board between said retracted and extended positions in response to selective actuation of said drive rod.

20. The method of claim 17 wherein said tilt linkage assembly is journally supported on said support shift and operably coupled to said drive rod for simultaneous operation with said leg rest assembly, wherein when said leg rest assembly is in said retracted position, said tilt linkage assembly is in a non-tilted position, and when said leg rest assembly is in said extended position, said tilt linkage assembly is in a tilted position.

21. The method of claim 20 wherein said actuation mechanism further includes an over-center linkage operatively coupled to said drive rod, spring means coactive with said over-center linkage for biasingly retaining said leg rest assembly in said retracted position when said drive rod is rotated to a first position and for biasingly driving said leg rest assembly toward said extended position when said drive rod is rotated to a second position, and means for permitting said seat occupant to selectively rotate said drive rod between said first position and second positions.

22. The method of claim 21 further comprising the step of assembling said tilt linkage assembly, said pantograph linkage means and said over-center linkage to said drive rod and said support shaft of said actuation mechanism prior to installation thereof between said side frame members.

23. The method of claim 21 further comprising the steps of:

providing a stationary base assembly; and interconnecting said rigid chair frame to said base assembly so as to permit pivotable movement of said chair frame with respect to said base assembly about said horizontal axis.

24. The method of claim 23 further comprising the step of interconnecting said tilt linkage assembly between said base assembly and said chair frame operable for raising and rearwardly tilting the front of said chair frame relative to said base assembly about said horizontal axis when said drive rod is moved from said first position to said second position, and operable for lowering the front of said chair frame from said tilted position when said drive rod is moved from said second position to said first position.

25. The method of claim 24 wherein said side frame members, said cross frame members, said seat back, said seat and said leg rest frame member are upholstered prior to modular assembly into said tiltable chair.

26. A method for assembling a reclining/tilt chair having a stationary base comprising:

providing an actuation mechanism;

suspending said actuation mechanism between a pair of side frame members;

interconnecting cross rail members with said side frame members to define a chair frame within which said actuation mechanism is operably supported;

providing a seat assembly having a seat, a seat back, and swing link means for pivotally interconnecting said seat back and said seat;

connecting said swing link means to said side frame members for suspending said seat assembly therebetween, said swing link means operable to permit reclining movement of said seat assembly with respect to said chair frame between an upright position and a reclined position in response to pressure applied by a seat occupant to said seat back;

connecting said seat to said actuation mechanism for guiding the longitudinal movement of said seat in response to said reclining movement of said seat assembly; and attaching said chair frame to said base along a lateral horizontal axis for pivotal movement of said chair frame relative to said base about said axis, said actuation mechanism operable to tilt said chair frame rearwardly on said horizontal axis relative to said base.

27. The method of claim 26 wherein said actuation mechanism includes first and second shafts, and wherein said step of suspending said actuation mechanism comprises:

inserting opposite ends of said first shaft within a first set of alignable bores formed in said side frame members for supporting said first shaft therebetween; and inserting opposite ends of said second shaft within a second set of alignable bores formed in said side frame members for supporting said second shaft therebetween.

28. The method of claim 27 wherein said steps of connecting said swing link means and said seat comprise:

connecting said swing link means to a third set of alignable bores formed in said side frame members;

providing guide means for guiding and limiting the fore and aft movement of said seat with respect to said first shaft in response to reclining movement of said seat assembly; and connecting a frame portion of said seat to said guide means.

29. The method of claim 27 wherein said first shaft of said actuation mechanism is a front support shaft and said second shaft is a drive rod, said drive rod and said support shaft being rigidly maintained in a predetermined spatial arrangement to permit sliding insertion of the opposite ends thereof into said first and second sets of alignable bores formed in said side frame members, and wherein said drive rod is selectively rotatable with respect to said second set of alignable bores while said support shaft is inhibited from rotation within said first set of alignable bores in response to rotation of said drive rod.

30. The method of claim 29 further comprising the steps of operably supporting a tilt linkage means from said front support shaft and said drive rod of said actuation mechanism and connecting said tilt means to said base for movement of said support shaft between a non-tilted position and a tilted position in response to selective rotation of said drive rod, said tilting movement of said support shaft being independent from said reclining movement of said seat assembly.

31. The method of claim 5 wherein said tilt linkage means comprises a push link, a pivot lever and a lift link, said pivot link being journally suspended from said support shaft and coupled to said drive rod and to said base such that selective rotation of said drive rod pivots said pivot lever which in turn moves said support shaft between said non-tilted and tilted positions.

32. The method of claim 31 further comprising the step of operably supporting a leg rest assembly from said front support shaft and said drive rod of said actuation mechanism for movement between a retracted position and an extended position in response to selective rotation of said drive rod, said movement of said leg rest assembly being independent from said reclining movement of said seat assembly.

33. The method of claim 32 wherein said leg rest assembly includes a leg rest frame board and a pantograph linkage, said pantograph linkage being journally suspended from said support shaft and directly coupled to said drive rod such that selective rotation of said drive rod moves said leg rest frame board between said retracted and extended positions.

34. The method of claim 33 wherein said actuation mechanism further includes an over-center linkage coupled to said drive rod, spring means coactive with said over-center linkage for biasingly retaining said leg rest assembly in said retracted position when said drive rod is rotated to a first position and for biasingly driving said leg rest assembly toward said extended position when said drive rod is rotated to a second position, and means for permitting said seat occupant to selectively rotate said drive rod between said first position and second positions.

35. The method of claim 34 further comprising the step of assembling said pantograph linkage, said over-center linkage and said tilt linkage means to said drive rod and said support shaft of said actuation mechanism prior to installation thereof between said side frame members.

36. The method of claim 34 further comprising the steps of:

interconnecting said rigid chair frame to said base assembly so as to permit pivotable movement of said chair frame with respect to said base assembly, said pivotable movement being independent of said reclining movement of said seat assembly.

37. The method of claim 36 further comprising the step of interconnecting said tilt linkage means between said base assembly and said chair frame for selectively tilting said chair frame relative to said base assembly when said drive rod is moved between said second position and said first position.

38. The method of claim 5 further comprising the step of providing stop means between said side frame members and said base assembly to assist in making said chair rigidly stationary in said non-tilted and tilted positions.

39. The method of claim 29 further comprising the step of upholstering said left and right side frame members and said cross frame members prior to interconnection into said rigid chair frame.

40. The method of claim 29 further comprising the steps of:

interconnecting said rigid chair frame to said base assembly so as to permit pivotable movement of said chair frame with respect to said base assembly, said pivotable movement being independent of said reclining movement of said seat assembly and interconnecting said tilt linkage means between said base assembly and said chair frame for selectively tilting said chair frame relative to said base assembly when said drive rod is moved between said second position and said first position.

* * * * *

UNITED STATES PATENT AND TRADEMARK OFFICE

CERTIFICATE OF CORRECTION

PATENT NO. : 5,222,286

DATED : June 29, 1993

INVENTOR(S) : Jonathan R. Saul, et al.

It is certified that error appears in the above-identified patent and that said Letters Patent is hereby corrected as shown below:

Column 1, Line 49,
After "frame" insert -- member in order to prevent interference with the pantograph linkage that protrudes from the front--.

Column 3, Line 41,
"appendec" should be --appended--.

Column 21, Line 60, Claim 31
"5" should be --30--.

Column 22, Line 46, Claim 38
"5" should be --30--.

Signed and Sealed this

Twenty-ninth Day of March, 1994

*Attest:*

Bruce Lehman

BRUCE LEHMAN

*Attesting Officer*

*Commissioner of Patents and Trademarks*